US011867007B2

(12) United States Patent
Witte et al.

(10) Patent No.: US 11,867,007 B2
(45) Date of Patent: Jan. 9, 2024

(54) SAFE STAB AND SELF-ALIGNING COILED TUBING APPARATUS

(71) Applicant: PREMIER COIL SOLUTIONS, INC., Waller, TX (US)

(72) Inventors: M. Brett Witte, Waller, TX (US); Randall Dean Behrens, Sealy, TX (US); Michael Bailey, Spring, TX (US)

(73) Assignee: PREMIER COIL SOLUTIONS, INC., Waller, TX (US)

( * ) Notice: Subject to any disclaimer, the term of this patent is extended or adjusted under 35 U.S.C. 154(b) by 0 days.

(21) Appl. No.: 17/320,770

(22) Filed: May 14, 2021

(65) Prior Publication Data

US 2021/0355768 A1 Nov. 18, 2021

Related U.S. Application Data

(60) Provisional application No. 63/025,268, filed on May 15, 2020.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 4,673,035 A * 6/1987 Gipson ..... E21B 19/22 166/85.1
10,787,870 B1 * 9/2020 Fulks ..... E21B 19/081
2008/0314580 A1 * 12/2008 Wood ..... E21B 7/02 166/77.2

* cited by examiner

*Primary Examiner* — Robert E Fuller
(74) *Attorney, Agent, or Firm* — Hunton Andrews Kurth LLP

(57) ABSTRACT

The present invention pertains novel coil tubing units and methods of stabbing. The coiled tubing unit has a tubing reel; a tubing guide operably connected to the tubing reel; and an injector operably connected to the tubing guide. The injector is configured to move toward or away from the tubing reel. This advantageously allows for more convenient, effective, and/or potentially safer stabbing methods to be employed.

11 Claims, 2 Drawing Sheets

SAFE STAB AND SELF-ALIGNING COILED TUBING APPARATUS

CROSS REFERENCES

This application claims benefit of U.S. Provisional Application No. 63/025,268, filed May 15, 2020, which is incorporated by reference in its entirety.

FIELD OF INVENTION

This invention relates to the application of delivery methods of coiled tubing into and through a coiled tubing injector. This addresses the industry-wide ability to safely "stab" pipe into the injector and control the movements of the coiled tubing along the path of the tubing guide and into the injector without manual adjustments.

BACKGROUND AND SUMMARY

Coiled Tubing was developed in the 1960's. A Coiled Tubing Unit (CTU) is equipped with a string of long continuous metal pipe normally 1"-3.5" in diameter, spooled onto a large reel which is centered on a large trailer, skid, or truck, for deployment using a machine called an injector to perform well intervention duties. These duties used to be performed by a number of different machines, crews, and units, and some have been combined into a single unit or CTU that is capable of performing tasks that were not possible with one unit 10 years ago. This long continuous pipe or "Tubing" has a brief lifecycle, which can be ruined with a single puncture, or cut. The Tubing is no longer effective once separated, and needs to remain in one piece. Tubing generally is no longer useful after being deployed or spooled to a footage of approximately 750,000 to 1.5 million running feet. Once it leaves the tubing facility, the time starts on the lifecycle or amount of total footage deployed and returned to the CTU. The tubing is sent down-hole into either an oil or gas well, and performs a well service event, and gets spooled back on the CTU. Depending on the operation and function of what is performed down-hole, it may take upwards of 10 trips of deployment and spooling to complete the action. This repetitive operation gets added into the lifecycle of the pipe, and depending on how actively the unit is used, it will reach the end of its' cycle and the tubing must be removed and re-spooled with new pipe in a matter of typically two to three months. After the tubing is re-spooled, the operator(s) of the unit must perform a task to introduce the coiled tubing into the coiled tubing injector or commonly known in the industry as "Stabbing". Stabbing is arguably the most dangerous operation that is conducted; because it involves orchestrated movements between humans and an extremely unstable length of the coiled tubing spool which is under tension.

When spooled, the tubing is cut at the end and affixed securely to prevent it from unspooling. While under tension, the tubing is not able to be controlled by human methods due to its sheer weight and the forces that are keeping it in the spool. Common methods of control include attachment of the end of the tubing to a crane to stabilize the tubing for stabbing. The tubing must be introduced through the tubing counter which counts the footage of pipe deployed/retrieved by use of methods such as a mechanical counter wheel(s) and next the tubing must be payed out by the CTU operator in concert with the crane operator and guided by humans movements into the tubing guide and into the injector. While these movements take place, humans are in the direct path of the tensioned tubing, and if any movements are not controlled, the tubing will cause serious injury and/or death to anyone near.

The act of stabbing is also dangerous to the lifecycle of the injector and its various parts. When stabbing, the injector is introduced to the tubing which is somewhat guided into the opening and into the chain mounted gripper blocks. If the appropriate angle of the tubing is not achieved, and maintained throughout the stabbing process, damage to a gripper block, a bearing on the gripper block assembly, and/or the chain can occur. This presents a problem to the operators, whereas, the damage may not be visibly apparent from the striking of the tubing, and may present itself at a later time. This is not an ideal situation, and does occur frequently during stabbing and the first several hundred foot of operation. When damage is found from stabbing during operation, the injector is anywhere from 25 ft-100+ft in the air, and has tubing inside it, and into the wellhead. This presents an even greater danger to operators for the repairs that have to be made at height.

After the stabbing process is completed, minor adjustments are usually conducted on the tubing guide which is attached to the top of the injector. The primary purpose of the tubing guide is to be a bridge between the coiled tubing reel and the injector; whereas, the tubing guide takes the tubing from the reel and bends it downwards into the injector. The tubing guide can normally be adjusted to allow for different size tubing and assists in the alignment of the tubing into the injector which transmits the injector alignment into the wellhead. Improper alignment from the tubing guide can cause extreme or undue wear on the tubing, shortening the life span considerably, and/or damage the tubing by impact scars from the improper contact. These scars can weaken the tubing and lead to puncture or a catastrophic ripping of the tubing. The marking of the tubing may not be apparent until the tubing is coming back up from the well, and by that time, damage is already sustained and is irrecoverable. The importance of proper tubing guide set-up has been proven to not only lengthen the life of the coiled tubing, but to further reduce wear on the injector and tubing guide.

Advantageously, the methods described herein meet many of the needs of the coil tubing industry to safely deploy coil tubing.

DETAILED DESCRIPTION

Figure 1:
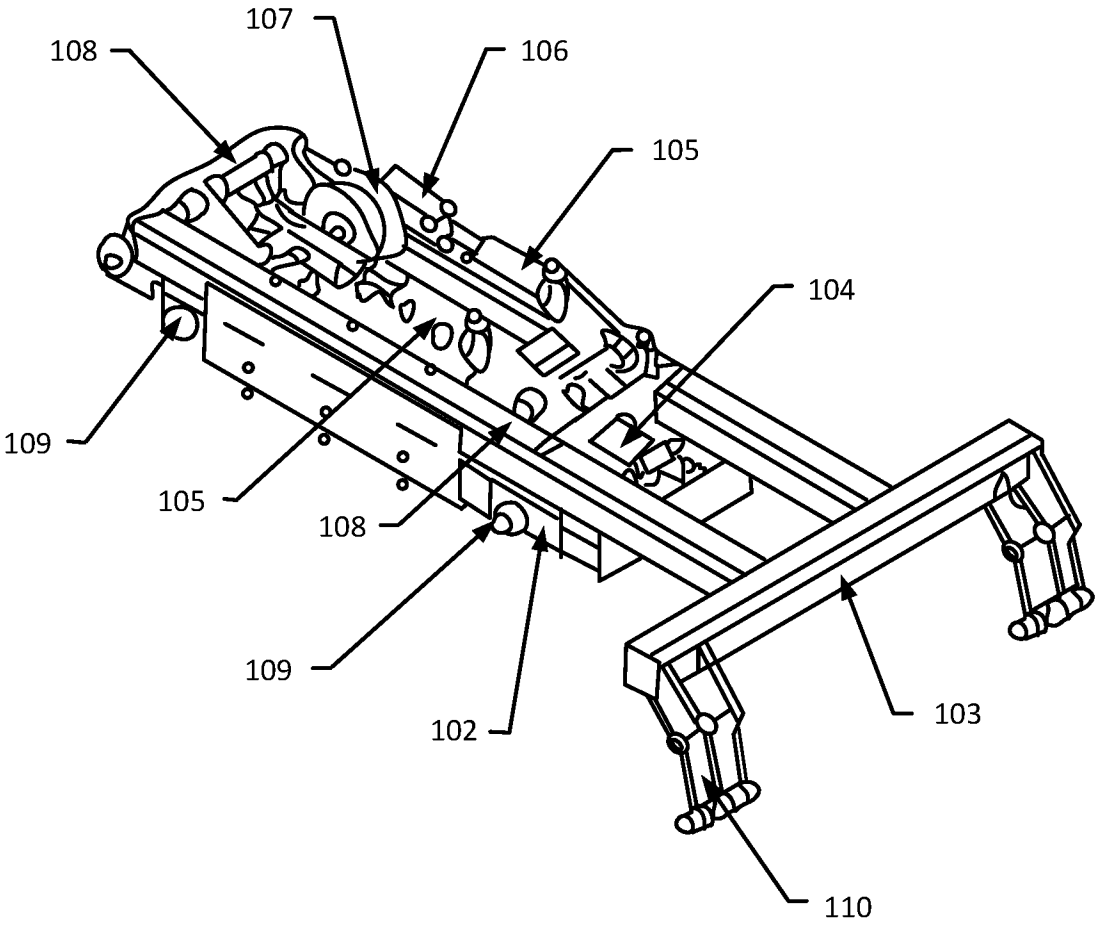
FIGS. 1 and 2 show various embodiments of coil tubing units and processes of the present invention.
Figure 2:
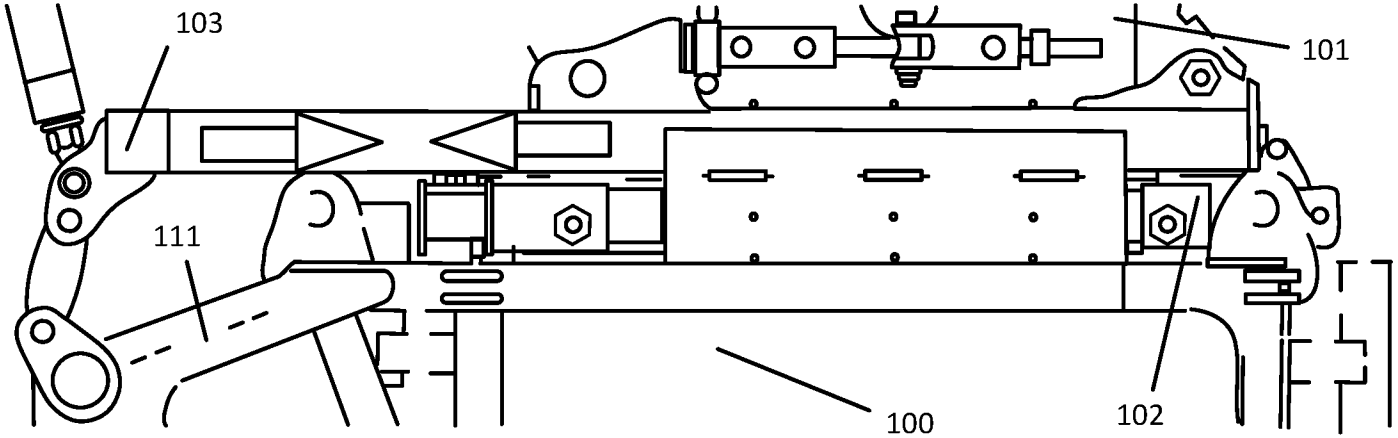

A Safe-Stab and Self Aligning Tubing Apparatus is disclosed. FIG. 1 illustrates one embodiment. In one embodiment, the apparatus may be mounted below the tubing guide (101), and in another embodiment, above the injector (100). The apparatus may be affixed to the injector using bolts (109), and affixed to the tubing guide using the bolts (108). The top slide support (103) is affixed via the floating link arms (110) which are attached to the injector A-Frame (111) (see fit-up in FIG. 2). The floating link arms (110) allow for movement in the setting of the tubing guide during stabbing operations to allow for forward and rearward movements, and as well as during operations to allow for the natural curvature of the tubing as it enters the injector from the tubing guide (101). The Hydraulic Cylinders (104) move the top slide support (103) and the entire tubing guide (101) for alignment, while the lower slide support (102) remains secured by the bolts (109). The cylinders (104) are actuated to set to the approximate alignment for the stabbing. Once that position has been achieved by the operator, the operator will release the actuation and the cylinder will be in a free float state and able to extend and retract as needed via a hydraulic accumulator or other device. The other hydraulic cylinders (105) only control any number of roller(s) (107) by shifting the alignment in a more precise angle plane to allow for further tubing bend without severe contact or damage to injector chain mounted equipment. Once adjusted, the cylinders (106) are stopped of movement and maintain their extended/retracted state to keep the proper adjustment of the tubing, allowing for the floating movement of the cylinders (104).

Certain embodiments disclose an apparatus that is either stand-alone or can be permanently or temporarily affixed to a coiled tubing injector or tubing guide, which is designed to move and float with the natural flex of the coiled tubing entering in the structure.

The Safe-Stab and Self Aligning Tubing Apparatus disclosed herein allows for floating and controlled movement by the use of hydraulic cylinders, electrical actuation, or springs or other mechanical means to allow the apparatus to move back and forth or side to side to adjust to the natural or induced movements of the coiled tubing.

The Safe-Stab and Self Aligning Tubing Apparatus disclosed herein may include one or more rollers mounted to a stabilization or resistance system capable of adjustments in any direction, based on pipe movements The Safe-Stab and Self Aligning Tubing Apparatus disclosed herein may employ electric, hydraulic, or manual methods of detecting a change in direction of the coiled tubing and the apparatus adjusts its stance to adapt.

The Safe-Stab and Self Aligning Tubing Apparatus disclosed herein may be assisted in movements by software programming, and or adapt in movement based on software programs or previous movements, or via remote control or mobile phone and or tablets.

The Safe-Stab and Self Aligning Tubing Apparatus disclosed herein may employ hydraulic cylinders that can work in unison to make adjustments and may or may not be actuated via a pressure device whether air, fluid, or electric driven or maintained by an accumulator.

The Safe-Stab and Self Aligning Tubing Apparatus disclosed herein may employ a method of attachment to the injector and tubing guide via bolts, pins or any method in which stability and mounting can be achieved while maintaining operational practicality.

Embodiments

The Safe-Stab and Self Aligning Tubing Apparatus disclosed herein allows for floating and controlled movement by the use of hydraulic cylinders, electrical actuation, or springs or other mechanical means to allow the apparatus to move back and forth or side to side to adjust to the natural or induced movements of the coiled tubing. The Safe-Stab and Self Aligning Tubing Apparatus disclosed herein may employ a method of attachment to the injector and tubing guide via bolts, pins or any method in which Stability and mounting can be achieved while maintaining operational practicality.

The Safe-Stab and Self Aligning Tubing Apparatus disclosed herein may include one or more rollers, bearings, or friction disks whether they are mounted to the apparatus, tubing guide, or injector, or mounted to a stabilization or resistance system capable of adjustments in any direction, based on pipe movements and/or pipe size changes whether they are diametric changes, or changes based on tubing ovality due to stress or wear.

The Safe-Stab and Self Aligning Tubing Apparatus disclosed herein may employ electric, hydraulic, or manual methods of detecting a change in direction of the coiled tubing and the apparatus adjusts its stance to adapt.

The Safe-Stab and Self Aligning Tubing Apparatus disclosed herein may be assisted in movements by software programming, and or adapt in movement based on software programs or previous movements, or via remote control or mobile phone and or tablets or any electronic component.

The Safe-Stab and Self Aligning Tubing Apparatus disclosed herein may employ hydraulic cylinders that can work in unison to make adjustments and may or may not be actuated via a pressure device whether air, fluid, or electric driven or maintained by an accumulator or other energy storage device or device which relieves systematic inconsistencies in pressure or energy.

Embodiments

1. A method for aligning coiled tubing through a coiled tubing injector comprising:
   introducing a length of coiled tubing which is under tension into an injector comprising a tubing guide and one or more gripper blocks; and
   injecting the length of coiled tubing into a well;
   wherein a self-aligning tubing apparatus is affixed to the injector and wherein the self-aligning tubing apparatus comprises:
   a top slide support affixed to the injector and comprising one or more link arms; and
   one or more hydraulic cylinders configured to move the top slide support, the tubing guide, or both to align the coiled tubing.
2. The method of embodiment 1 wherein the one or more hydraulic cylinders are actuating hydraulic cylinders and wherein actuating the actuating hydraulic cylinders aligns the coiled tubing.
3. The method of embodiment 2 further comprises releasing the actuating such that the one or more hydraulic cylinders extend, retract, or both to maintain alignment of the coiled tubing.
4. The method of embodiment 3 wherein the method further comprises employing a hydraulic accumulator.
5. The method of embodiment 1 wherein the one or more hydraulic cylinders are configured to align the coiled tubing by shifting an angle plane to bend the coiled tubing.
6. The method of embodiment 1 wherein the self-aligning tubing apparatus affixed to the injector is releasably affixed.
7. The method of embodiment 2 wherein the actuating hydraulic cylinders are actuated with a pressure device.
8. A self-aligning tubing apparatus configured to be affixed to a coiled tubing injector wherein the self-aligning tubing apparatus comprises:
   a top slide support configured to affix the self-aligning tubing apparatus to coiled tubing injector and comprising one or more link arms; and
   one or more actuators configured to move the top slide support, a tubing guide on the injector, or both to align the coiled tubing.
9. The self-aligning tubing apparatus of embodiment 8 wherein the one or more actuators are selected from one or more actuating hydraulic cylinders, one or more electric actuators, one or more springs, or any combination thereof.

10. The self-aligning tubing apparatus of embodiment 8 wherein the one or more actuators are actuated with a pressure device.

11. The self-aligning tubing apparatus of embodiment 8 wherein the one or more actuators are configured to maintain alignment of the coiled tubing upon release of actuating.

12. The self-aligning tubing apparatus of embodiment 8 wherein the apparatus is configured to move with a flex of coiled tubing.

13. The self-aligning tubing apparatus of embodiment 8 wherein the one or more actuators are configured to align the coiled tubing by shifting an angle plane to bend the coiled tubing.

14. A self-aligning tubing apparatus configured to be affixed to a coiled tubing injector or a tubing guide wherein the self-aligning tubing apparatus comprises:

a top slide support configured to affix the self-aligning tubing apparatus to a coiled tubing injector or a tubing guide; and one or more actuating hydraulic cylinders wherein actuating the actuating hydraulic cylinders aligns the coiled tubing by shifting an angle plane to bend the coiled tubing; wherein the apparatus is configured to move with a flex of coiled tubing.

While the embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims. The appended drawings illustrate only typical embodiments of the disclosed methods and systems and therefore are not to be considered limiting of its scope and breadth.

The invention claimed is:

1. A method for aligning coiled tubing through a coiled tubing injector comprising:

introducing a length of coiled tubing which is under tension into an injector comprising a tubing guide and one or more gripper blocks; and injecting the length of coiled tubing into a well;

wherein a self-aligning tubing apparatus is mounted above the injector and wherein the self-aligning tubing apparatus comprises:

a top slide support affixed to the injector and comprising one or more link arms configured to allow forward and rearward movement to allow for the curvature of the coiled tubing during introducing of the coiled tubing into the injector and during operation; and one or more hydraulic cylinders configured to move the top slide support to align the coiled tubing with the injector.

2. The method of claim 1 wherein the one or more hydraulic cylinders are actuating hydraulic cylinders and wherein actuating the actuating hydraulic cylinders aligns the coiled tubing by moving the top slide support thereby shifting an angle plane to bend the coiled tubing.

3. The method of claim 2 further comprises releasing the actuating such that the one or more hydraulic cylinders maintain alignment of the coiled tubing upon release of actuating by maintaining their extended or retracted state to keep the proper adjustment of the tubing.

4. The method of claim 3 wherein the method further comprises employing a hydraulic accumulator.

5. The method of claim 2 wherein the actuating hydraulic cylinders are actuated with a pressure device.

6. The method of claim 1 wherein the self-aligning tubing apparatus affixed to the injector is releasably affixed.

7. A self-aligning tubing apparatus configured to be mounted above a coiled tubing injector wherein the self-aligning tubing apparatus comprises:

a top slide support configured to affix the self-aligning tubing apparatus to the coiled tubing injector and comprising one or more link arms configured to allow forward and rearward movement to allow for the curvature of the coiled tubing during introducing of the coiled tubing into the injector and during operation; and one or more actuators configured to move the top slide support to align the coiled tubing.

8. The self-aligning tubing apparatus of claim 7 wherein the one or more actuators are selected from one or more actuating hydraulic cylinders, one or more electric actuators, one or more springs, or any combination thereof.

9. The self-aligning tubing apparatus of claim 7 wherein the one or more actuators are actuated with a pressure device.

10. The self-aligning tubing apparatus of claim 7 wherein the one or more actuators are configured to maintain alignment of the coiled tubing upon release of actuating by maintaining their extended or retracted state to keep the proper adjustment of the tubing.

11. The self-aligning tubing apparatus of claim 7 wherein the one or more actuators are configured to align the coiled tubing by moving the top slide support thereby shifting an angle plane to bend the coiled tubing.

* * * * *